United States Patent [19]

Kolbow

[11] 4,078,601

[45] Mar. 14, 1978

[54] HEATING AND COOLING THERMOSTAT WITH CHANGEOVER SWITCHING OPERATED UPON CONTROL POINT ADJUSTMENT

[75] Inventor: Donald P. Kolbow, Minneapolis, Minn.

[73] Assignee: Honeywell Inc., Minneapolis, Minn.

[21] Appl. No.: 712,118

[22] Filed: Aug. 5, 1976

[51] Int. Cl.[2] ..... H01H 37/72; F25B 29/00

[52] U.S. Cl. ..... 165/26; 236/1 C; 337/340

[58] Field of Search ..... 236/1 C, 68 B; 165/26, 165/27; 337/337, 340, 360, 374

[56] References Cited

U.S. PATENT DOCUMENTS

| | | | |
|---|---|---|---|
| Re. 28,676 | 1/1976 | Edelman et al. | 236/1 C |
| 2,403,798 | 7/1946 | Holmes | 165/26 X |
| 2,729,719 | 1/1956 | Kronmiller | 337/360 |
| 3,046,375 | 7/1962 | Houser | 337/337 |

OTHER PUBLICATIONS

Honeywell Thermostats, T87F Residential Div. Form # 60-2222-1, Rev. 7-75.

*Primary Examiner*—William E. Wayner
*Attorney, Agent, or Firm*—Clyde C. Blinn

[57] ABSTRACT

A thermostat adapted for controlling heating and cooling apparatuses has a temperature control point adjustment means connected to a changeover switch means whereby upon the adjustment of the temperature control point adjustment means in a first range to select a cooling point, the changeover switch means only connects the thermostat to the cooling apparatus and when the temperature control point adjustment means is in the heating range, the changeover switch means only connects the thermostat to the heating apparatus. The limited range of temperature selection in the first and second range is an energy conservation feature of the thermostat.

13 Claims, 7 Drawing Figures

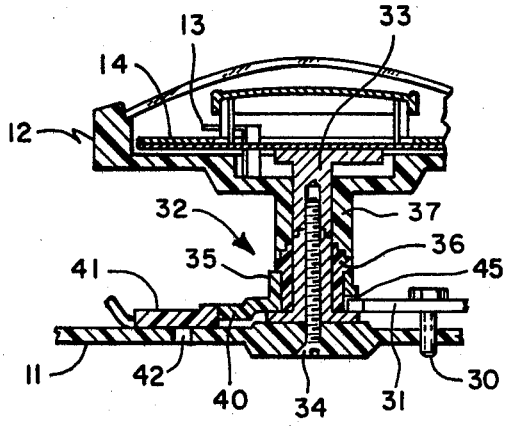
FIG. 4
FIG. 5
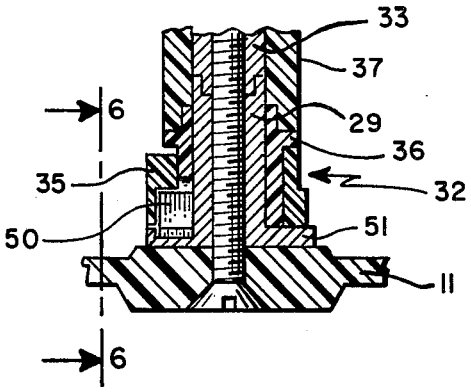
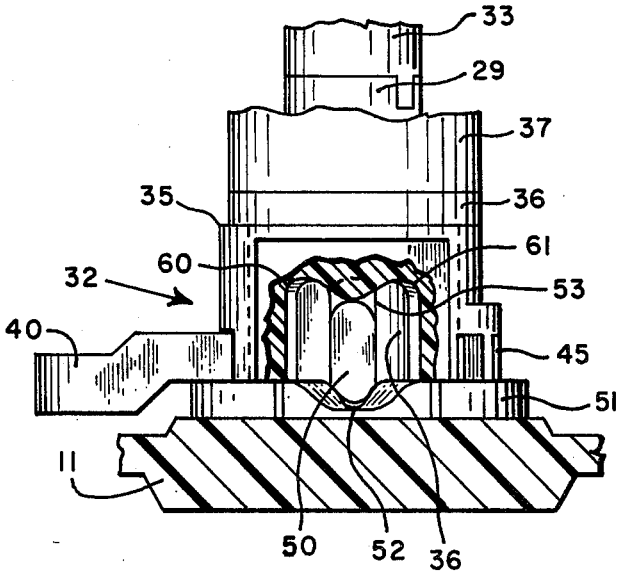
FIG. 6
FIG. 7
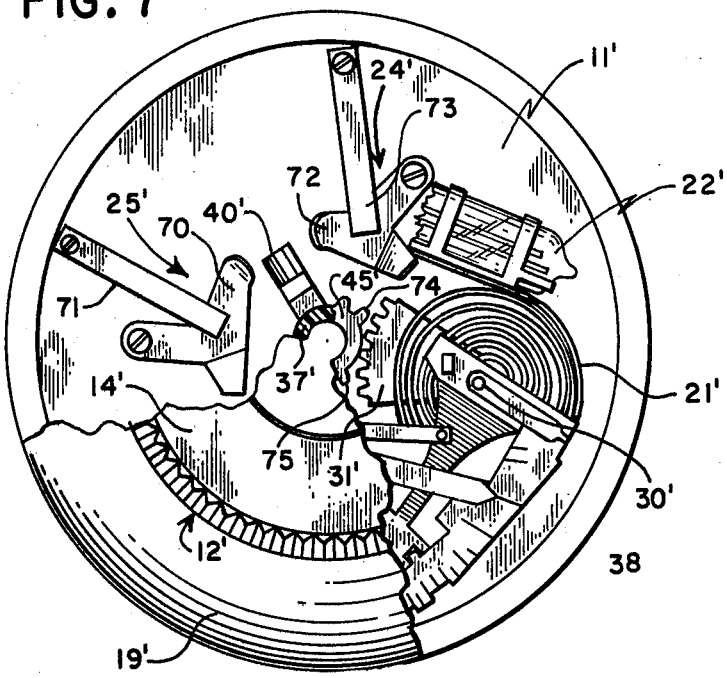

HEATING AND COOLING THERMOSTAT WITH CHANGEOVER SWITCHING OPERATED UPON CONTROL POINT ADJUSTMENT

BACKGROUND OF THE INVENTION

For a number of years, a single wall thermostat has been available for controlling both heating and cooling apparatus supplying either heated or cooled air to a space in which the thermostat is mounted. Such a thermostat might have a single temperature responsive means for operating a switch for both cooling and heating as shown in the Walter E. Edelman et al U.S. Pat. RE. No. 28,676, reissued Jan. 13, 1976, wherein a subbase contains switches for selectively providing the changeover operation to connect the thermostat to control either heating apparatus or cooling apparatus. Other types of thermostats contain separate temperature responsive switch means each controlling heating apparatus or cooling apparatus to provide automatic changeover between the heating and cooling operation such as shown in the Elmer A. Carlson U.S. Pat. No. 2,978,228, issued Apr. 4, 1961. In these thermostats an almost unlimited range of control point adjustment is provided.

Prior art thermostats have had various ways, such as adjustable stops as shown in the Carl G. Kronmiller U.S. Pat. No. 2,729,719, issued Jan. 3, 1966, of limiting the temperature adjustment to some energy conserving level both in the heating and cooling operation. With the advent of a more recognized need to conseve energy, the need for even more sophisticated limiting means for a thermostat setting control point adjustment is recognized.

The present invention provides a thermostat for use for controlling heating and cooling apparatus wherein a control point adjustment in either the heating or cooling range is limited to conserve energy. Furthermore, the thermostat provides for the changeover from heating to cooling operation by means of a less expensive changeover switch apparatus to eliminate the previously used subbase, therefore, a thermostat is available at a lower cost to the consumer. Specifically, the thermostat has a control point adjustment knob which can be adjusted in a cooling range of temperatures or a heating range of temperatures, each of the ranges are limited to provide temperatures for the conservation of energy. The control point adjustment knob is connected to a changeover switch in the thermostat; so that, upon a movement of the control point adjustment knobs from the cooling range to the heating range, the changeover switch is operated. The operation of heating or cooling apparatus when the control point adjustment knob is in the cooling or heating range, respectively, is prevented.

The embodiments of the present invention are shown in the figures of which

Figure 1:
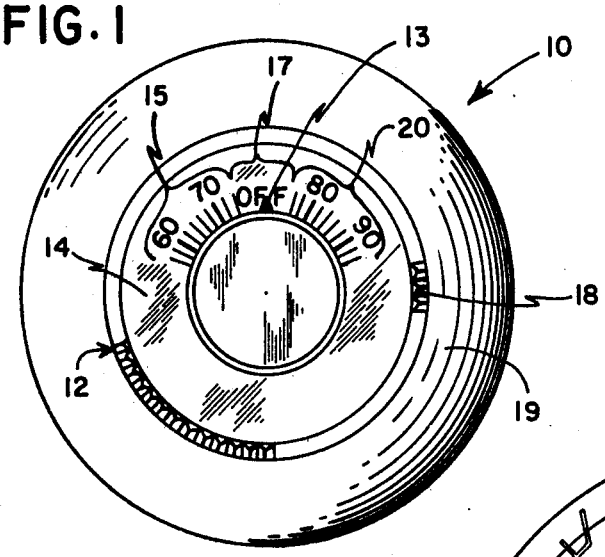
Figure 3:
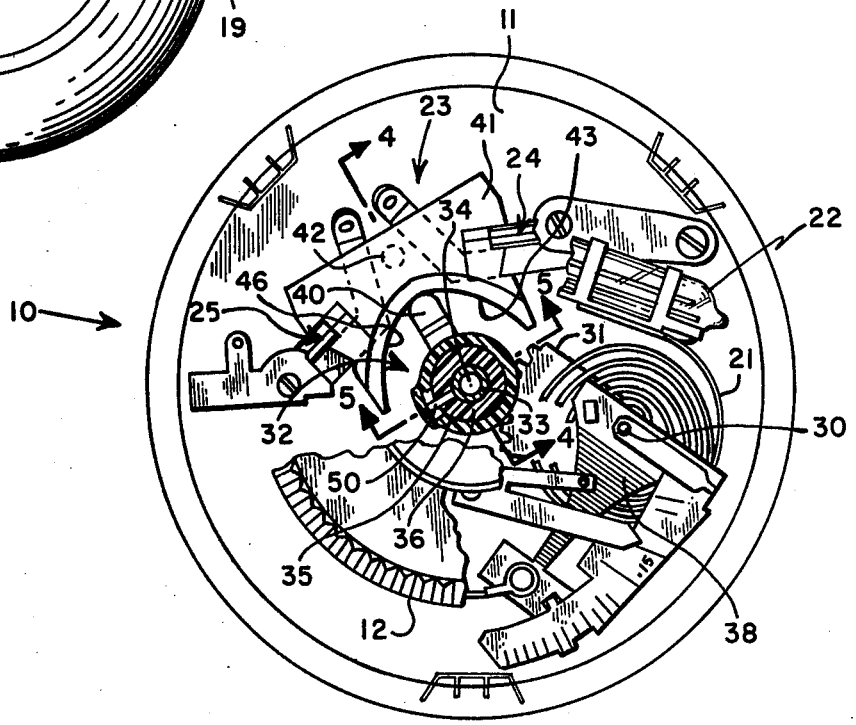
Figure 2:
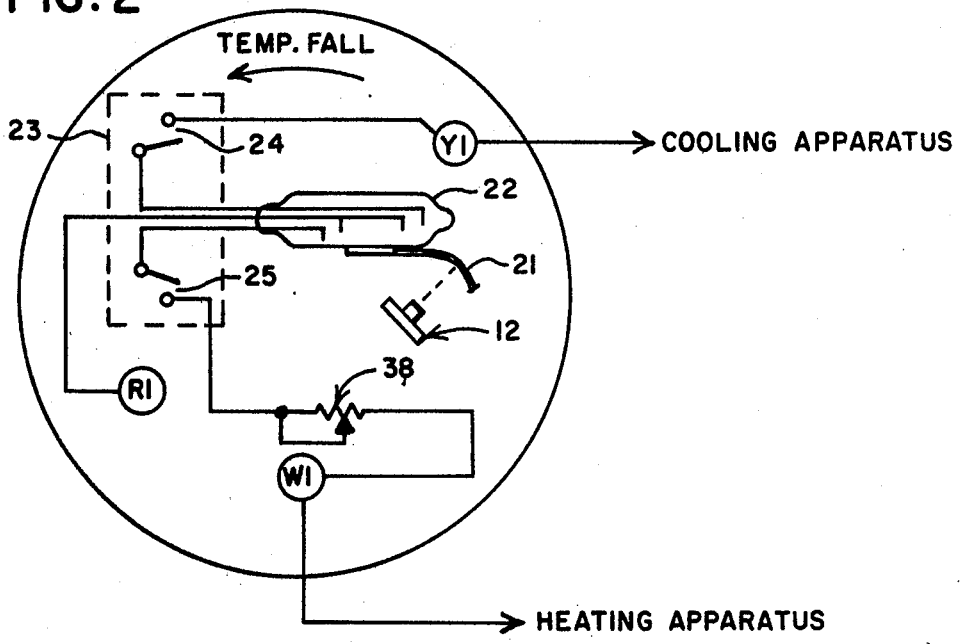

FIG. 1 is a front view of the thermostat showing a typical temperature scale with the two control point adjustment ranges separated by the off position, and FIG. 2 is a schematic diagram of one typical electrical connection of the thermostat, FIG. 3 is a cutaway view of the thermostat of FIG. 1, showing the bimetal operated switch and the changeover switch, FIG. 4 is a cutaway view of the center shaft of the thermostat as shown in FIG. 2, and FIG. 5 is an enlarged view of the center shaft of the thermostat shown in FIGS. 2 and 4, FIG. 6 is an enlarged view of a portion of the center shaft shown in FIG. 5, and FIG. 7 is a second embodiment of the thermostat shown in FIG. 1.

DESCRIPTION OF THE INVENTION

Referring to FIG. 1, the thermostat 10 has a base 11 (not shown) to which a temperature control point adjustment member or knob 12 is rotatably attached for selecting or adjusting a temperature control point by positioning a pointer or indicator 13 in a series of positions. Indicator 13 cooperates with a stationary temperature scale or index 14 having a first range 15 for selecting a heating temperature control point and a second range 20 for selecting a cooling control point. The scale or ranges 15 and 20 are separated by an "off" range 17. Knob 12 has a serrated circumference portion 18 providing for ease of manual rotation of the temperature control point adjustment knob. A ring or cover 19 encloses the mechanism of the thermostat.

Thermostat 10 is adapted to be connected to control either cooling or heating apparatus as shown by an electrical system circuit in FIG. 2. A power source or secondary winding of a transformer (not shown) would be connected to terminal R1 and the other side of the heating and cooling control apparatus (not shown) as shown in the mentioned Edelman et al patent. The thermostat has a temperature responsive element or bimetal 21 connected to control the position and thus operation of a switch 22. Switch 22 has two portions similar to that of the Walter E. Edelman et al patent for controlling either the heating apparatus or cooling apparatus depending upon the operation of a changeover switch mechanism 23. When the switch 24 is closed, the thermostat is connected to control the cooling apparatus and when switch 25 is closed, the thermostat is connected to control the heating apparatus through the circuit including a conventional heat anticipation heater 38. The adjustment of the control point of the thermostat by moving the position of bimetal 21 is accomplished by the rotation of knob 12 shown in FIG. 1, to select a heating operating temperature in the range 15 (58° to 75° F) while switch 25 is closed and to select a cooling operatng temperature in range 20 (75° to 94° F) while switch 24 is closed. When the temperature control point adjustment member 12 is rotated so that the indicator 13 is in the "off" position 17 as shown in FIG. 1, neither switch 25 nor 24 of FIG. 2 is closed and the heating and cooling apparatus is off. The range 15 has an upper heating temperature limit of 75° F and range 20 has a lower cooling temperature limit of 75° F, for energy conservation. With the limited ranges, there is no need for limit stops on the temperature adjustment knob 12.

Specifically, one embodiment of the thermostat as shown in FIG. 3 has bimetal 21 mounted on a post 30 which is attached normal to the base 10 so the position of switch 22 connected to the other extremity of the bimetal is adjusted as the temperature of the bimetal changes. Post 30 and bimetal 21 are connected to a gear sector 31 which is positioned by the movement of the control point adjustment knob 12 shown in FIG. 1 through a connection and lost motion mechanism 32. Mechanism 32 as shown in FIGS. 3 and 4, comprises a support shaft 33 which is rigidly attached to scale 14 and is held normal on base 11 splined to a post and support member 29 by a screw 34. A member or hub 37 is rotatably carried on shaft 33 and is connected to member 36 rotatably carried on shaft 29, for providing the connection to the gear sector 31 and the changeover switch operating member or lever 40 through member 35 to be described later.

The changeover switch mechanism 23, shown in FIG. 3, has a member 41 which is pivotally mounted on base 11 at pivot 42 and has associated therewith two switches 24 and 25. As lever 40 is rotated in either direction, it cooperates with the arcuate cam surfaces 43 and 46 of member 41 to cause movement of member 41 about its pivot 42 to operate one or the other of the switches 24 and 25. By a design of the intersection of cam surfaces 43 and 46, a small angle of rotation of knob 12 and movement of member 40 can take place without movement of the switch operator 41. Such provides an "off" range 17 of selected positions of the control point adjustment knob 12 in which the changeover switches 24 and 25 are in the off position. When member 40 is moved counterclockwise to engage surface 46, a pivotal force is applied to member 41 to rotate it about pivot 42 and close switch 25. Since surface 46 aligns with the arcuate movement of member 41 through range 15, member 41 will only pivot a predetermined angular amount to operate switch 25. Similarly, upon movement of member 40 clockwise to operate switch 24, the cooling apparatus is connected to switch 22.

Mechanism 32 is shown in more detail in FIGS. 4, 5 and 6. Referring to FIG. 4, knob 12 is shown rotatably supported on base 11 for movement of the changeover switch actuating lever 40 and gear sector 31 for adjusting the position of bimetal 21 through the gear sector 45 which is attached to member 37. Referring to FIG. 5, post member 29 and shaft 33 are held together on the base by screw 34 to support the scale plate 14. Rotatably connected on post 29 and shaft 33 is a key carrying driving post member or sleeve 36 which is attached to knob hub 37 of knob 12. A driven member or sleeve 35 is rotatably connected on the same axis to member 36. Member 36 carries a locking member or key 50 for interconnecting driven member 35 and driving member 36.

Referring to FIG. 6, the lower base portion or carrier 51 of post 29 has a notch 52 for receiving key 50 when the changeover switch lever 40 is in the position as shown in FIG. 3 and the changeover switch mechanism 23 is in the off position. When key 50 is in notch 52, the upper portion of the key clears the projection 53 of member 35 so that the key carrying driving member 36 is free to be rotated a small angle with control point adjustment knob 12 without moving driven member 35 and gear sector 45. A lost motion between the control point adjustment knob 12, and the gear sector 45, through the off range 17 of the thermostat is provided. Upon the movement of the key carrying member 36 by the rotation of knob 12 in either direction to the right or to the left, key 50 is lifted out of notch 52 until it is in a locking position to engage either detent or notch 60 or 61. Depending upon the direction of rotation, members 35 and 36 are locked together to rotate along with knob 12 to adjust the position of bimetal 21, through the range of rotation of the control point setting for either the cooling adjustment shown as 20 in FIG. 1, or the heating adjustment shown as 15.

In the operation of the thermostat, upon the movement of the temperature control point adjustment knob 12 from the off position as shown in FIG. 1, to select a temperature in the heating range 15, the movement of lever 40 rotates the changeover switch member 41. The heating changeover switch 25 connects the thermostat switch 22 to the heating apparatus. In any particular portion of range 15, the thermostat operates as a normal heating thermostat energizing the heating apparatus when the space temperature did not satisfy the temperature responsive bimetal 21. If the temperature control point adjustment was increased above 75° F, the changeover switch operates to open the heating switch 25 and limit the heating operation to 75° F. In the position above 75° F, lever 40 is in the position as shown in FIG. 3 and the changeover switch mechanism 23 has switches 24 and 25 in an open position. A similar operation is accomplished for cooling in the control point adjustment range 20 to limit the cooling temperature to a lower limit of 75° F.

In order to provide a range of operation of the control point adjustment knob 12 in the "off" position, between 75° F for heating and 75° F for cooling without changing the adjustment of the temperature control by bimetal 21, the lost motion is provided by means of locking member or key 50 of mechanism 32 which connects control point adjustment knob 12 to the gear sector 45. When the control point adjustment knob 12 reaches the off position, key 50, as shown in FIG. 6, drops into the the notch 52 and allows the knob through member 37 to continue to rotate through the off range 17 without carrying the member 35 and thus holdng the gear sector 45 in a fixed position through the off position. Mechanism 32 provides a larger movement of knob 12 within the control temperature adjustment of ranges 15 and 20, so a more positive off range 17 is provided. As soon as the control point adjustment knob 12 is moved into cooling range 20, shown in FIG. 1, key 50 as shown in FIG. 6, moves upward to engage notch 60 and lock the mechanism 32 to provide for a normal adjustment of the position of bimetal 21 through the cooling range of the control point adjustment knob 12.

DESCRIPTION OF SECOND EMBODIMENT

Referring to FIG. 7, another embodiment of the disclosure is shown having a base 11' to which a temperature responsive member or bimetal 21' is attached by a shaft 30' to be adjusted by the position of a gear sector 31' to determine the control point setting of the thermostat and thus the operation of switch 22'. The control point adjusting knob 12' is attached to the rotating shaft 37' which carries the gear sector 45' and the changeover switch operating lever 40'. Upon the rotation of the control point adjustment knob 12' from the off position as shown, to either the cooling operating range or the heating operating range, member 40' is moved to the left or right to operate either the cooling changeover switch 24' or the heating changeover switch 25'. Switches 24' and 25' are made up of resilient members which can be moved together to form the switches. As the switch member 40' moves to the left to engage resilient member 70 and lift the member away from the base to engage member 71 and heating changeover switch 25' is closed. Similarly, when member 40' moves to the right to engage resilient member 72 to lift the member away from the base to engage member 73, the cooling changeover switch 24'0 is closed.

To provide the lost motion for movement of the control point adjusting knob 12 in the off range 17 intermediate the heating and cooling ranges as shown in FIG. 1, gear sector 45' has a greater space between two adjacent teeth 74 and 75. An angle of rotation of shaft 37' by knob 12 can exist without any movement of the gear sector 311' until either tooth 74 engages the gear sector 31' or tooth 75 engages the gear sector 31' in one or the other direction. No change in the position of bimetal 21' takes place when knob 12' is moved in the "off" range 17.

The operation of the second embodiment is similar to that of the main embodiment in that upon an adjustment of the control point of the thermostat by rotation of knob 12', the position of the gear sector 31' and thus the temperature setting of bimetal 21'0 is selected. Depending upon which way the control point adjustment member is rotated, switch member 40'0 closes either of the system changeover switches 24' or 25' to provide for operation of the thermostat in either the limited heating or limited cooling range.

The embodiments of the invention in which an exclusive property or right is claimed are defined as follows:

1. In a thermostat adapted for controlling heating and cooling apparatuses comprising, a base member, temperature responsive switch means attached to said base member, temperature control point adjustment means mounted on said base member, a changeover switch means, connection means connecting said control point adjustment means to said switch means to change the operating temperature of said temperature responsive switch means and to said changeover switch means for selectively connecting either the heating apparatus or cooling apparatus to said temperature responsive switch means, said changeover switch means, comprising switch operating member pivotally connected to said base, said switch operating member having a cam surface cooperating with a drive arm connected to said control point adjustment means, said drive arm upon engaging said cam surface pivots said switch operating member.

2. The invention of claim 1 wherein, said cam surface being formed by an intersection of two similar cam surfaces whereby upon said drive arm moving in one direction or the other from a center position at said intersection, said switch operating member is moved to a switch operating position as said drive arm pivots through an arcuate path aligning with said cam surface.

3. The invention of claim 2 wherein, said intersection of said cam surfaces has a surface portion along which said drive arm can move without operating said switch means, said temperature control point adjustment means providing an off portion of its adjustment when said drive arm is on said surface portion.

4. The invention of claim 3 wherein said connection means connecting said adjustment means to said temperature responsive switch means comprising;

lost motion means to provide for no adjustment of said temperature responsive switch means when said control point adjustment means has said drive arm in said surface portion whereby an off range of the adjustment of said control point adjustment means can take place without movement of said temperature responsive switch means.

5. A thermostat apparatus adapted for controlling heating apparatus and cooling apparatus, comprising, temperature responsive control means responsive to space temperature, temperature control point adjustment means having a first series of positions for selecting a heating temperature and a second series of positions for selecting cooling temperature, first connection means connecting said control point adjustment means to said temperature control means to adjust the control temperature said temperature responsive control means maintains in the space, changeover switch means adapted to selectively connect said temperature responsive control means to control the operation of either the heating apparatus or the cooling apparatus, and second connection means connecting said temperature control point adjustment means to said changeover switch means so that when said control point adjustment means is in said first series of positions, said changeover switch means is adapted to connect the heating apparatus to said temperature responsive control means to control the temperature in the space at a selected heating temperature and when said control point adjustment means is in said second series of positions said changeover switch means is adapted to connect the cooling apparatus to said temperature responsive control means to control the temperature in the space at a selected cooling temperature, said second connection means comprising a switch operating member pivotally connected to a base, drive means connected to said temperature control point adjustment means whereupon movement of said adjustment means to either said first or second series of positions, said drive means operates said switch operating member.

6. The invention of claim 5 wherein said switch operating member is inoperative through a predetermined angle of said drive means to provide an off position for said control point adjustment means.

7. The invention of claim 6 wherein, said first connection means having a lost motion means to prevent adjustment of said temperature responsive control means in said off position, said lost motion means comprising, a first shaft connected to said control point adjustment means, a second shaft is rotatably connected on said first shaft, said second shaft connected to said temperature responsive control means, a locking member connecting said first and second shafts when said locking member is in a first position, a base member on which said locking member rides to bias said locking member in a connecting position, and means associated with said base member to bias said locking member away from said connecting position when said temperature control adjustment means is in said off position to allow movement of said temperature control point adjustment means to move independently of said temperature responsive control means.

8. A thermostat comprising a base adapted to be mounted on a surface in a space wherein the temperature is to be controlled for either cooling or heating, a first rotatable post member mounted normal to said base for supporting a bimetal to which a temperature control switch means is attached, a second rotatable temperature adjusting post member mounted normal to said base adjacent said first post member, drive means connecting said first and second post members so that upon the rotation of said second post member to a selected position, the position of said post member is adjusted to determine the control temperature of said switch means, said drive means having a lost motion means to provide for a predetermined angle of movement of said second post member without movement of said first post member, said lost motion means comprising a sleeve on said second post member having connection means to said first post member, said sleeve having a detent means therein, a key member carried by said second post member, said key is free to move parallel to the axis of said second post member, said key cooperating with said detent means to allow for movement of said second post with respect to said sleeve when said key is in a downward position out of said detent means.

9. The invention of claim 8 wherein, said detent means comprises first and second detents spaced apart by a predetermined angle, said key has means to move it in said downward position out of said first detent and then upward into said second detent when said second post member is rotated thereby providing for a disconnection between said second post member and said first post member in said predetermined angle of movement.

10. The invention of claim 9 wherein said means to move said key downward comprises, means associated with a base whereby in said predetermined angle of movement said key moves out of said first detent and then upward into said second detent.

11. The invention of claim 4 wherein said lost motion means comprises;

rotatable post member, sleeve means mounted on said post member, a key carried by one of said members for connecting said members for rotation together, and means to bias said key to a disconnecting position during a predetermined angle of movement of one of said members connected to said control point adjustment means in said off range whereby no movement of said temperature responsive switch means connected to said other of said members occurs.

12. The invention of claim 11 wherein one of said members having detent means for receiving said key, said detent means having at least two positions for said key, said key being biased out of one of said positions and into another of said positions during said predetermined angle of movement.

13. The invention of claim 12 wherein said key biasing means comprising a notch means aligned with said detent means whereby said key is held into one of said positions upon rotation of said control point adjustment means and biased to disconnect said control point adjustment means when in said off range.

* * * * *

UNITED STATES PATENT OFFICE

CERTIFICATE OF CORRECTION

PATENT NO. : 4,078,601

DATED : March 14, 1978

INVENTOR(S) : DONALD P. KOLBOW

It is certified that error appears in the above-identified patent and that said Letters Patent are hereby corrected as shown below:

Column 7, line 13, after "said" insert first.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*